US011326259B2

(12) United States Patent
Guedes

(10) Patent No.: US 11,326,259 B2
(45) Date of Patent: May 10, 2022

(54) CORROSION AND MAR RESISTANCE OF STEEL COMPONENTS

(71) Applicant: Snap-on Incorporated, Kenosha, WI (US)

(72) Inventor: Ricardo L M Guedes, Kenosha, WI (US)

(73) Assignee: Snap-on Incorporated, Kenosha, WI (US)

( * ) Notice: Subject to any disclaimer, the term of this patent is extended or adjusted under 35 U.S.C. 154(b) by 326 days.

(21) Appl. No.: 16/003,708

(22) Filed: Jun. 8, 2018

(65) Prior Publication Data

US 2019/0376188 A1 Dec. 12, 2019

(51) Int. Cl.

| | |
|---|---|
| ***C23C 28/04*** | (2006.01) |
| ***C23C 8/02*** | (2006.01) |
| ***C23F 11/167*** | (2006.01) |
| ***C23C 22/03*** | (2006.01) |
| ***C23C 8/42*** | (2006.01) |

(52) U.S. Cl.

CPC ..... *C23C 28/044* (2013.01); *C23C 8/02* (2013.01); *C23C 8/42* (2013.01); *C23C 22/03* (2013.01); *C23F 11/1676* (2013.01)

(58) Field of Classification Search

CPC ..... C23C 28/044; C23C 28/34; C23C 8/02; C23C 8/18; C23C 8/42; C23C 8/80; C23C 22/05; C23C 22/07; C23C 22/10; C23C 22/18; C23C 22/62; C23C 22/78; C23C 22/80; C23C 22/182; C23C 22/184; C23C 22/186; C23C 22/188; C23C 22/00; C23C 22/06; C23C 22/08; C23C 2222/10

See application file for complete search history.

(56) References Cited

U.S. PATENT DOCUMENTS

| | | | | |
|---|---|---|---|---|
| 7,964,044 | B1 * | 6/2011 | Block | C23C 22/78 148/252 |
| 2013/0139930 | A1 * | 6/2013 | Wagh | B32B 15/04 148/263 |
| 2020/0165731 | A1 * | 5/2020 | Badger, II | C23F 11/06 |

FOREIGN PATENT DOCUMENTS

| | | | |
|---|---|---|---|
| CN | 101210322 | A | 7/2008 |
| CN | 101376970 | A | 3/2009 |
| CN | 105214924 | A | 3/2009 |
| CN | 102011110 | B | 6/2014 |
| CN | 104711554 | A * | 6/2015 |
| CN | 105220140 | A | 1/2016 |
| CN | 107345295 | A | 11/2017 |
| CN | 107460471 | A | 12/2017 |
| CN | 107937901 | A | 4/2018 |
| CN | 108034938 | A | 5/2018 |
| JP | 2011058032 | | 3/2011 |
| JP | 2011058032 | A * | 3/2011 |
| WO | 2017078832 | A1 | 5/2017 |

OTHER PUBLICATIONS

United Kingdom Office Action for Application No. GB1907323.8, dated Oct. 30, 2019, 5 pages.

(Continued)

*Primary Examiner* — Lois L Zheng
(74) *Attorney, Agent, or Firm* — Seyfarth Shaw LLP

(57) ABSTRACT

A method of improving corrosion and mar resistance of steel components by creating a black magnetite finish, with a medium temperature process, prior to application of a phosphate layer coating.

9 Claims, 3 Drawing Sheets

(56) References Cited

OTHER PUBLICATIONS

Taiwan Office Action for Application No. 10920315640 dated Apr. 8, 2020, 4 pages.
Canadian Office Action for Application No. 3,043,712 dated Dec. 14, 2020, 4 pages.
Chinese Office Action for Application No. 201910493586.2 dated Jan. 6, 2021, 6 pages.
Canadian Office Action for corresponding CA Application No. 3,043,712, dated Jul. 14, 2021, 6 pages.
Chinese Office Action for corresponding CN Application No. 201910493586.2, dated Aug. 25, 2021, 9 pages.
United Kingdom Combined Search and Examination Report for corresponding UK Application No. GB2100614.3, dated Jul. 7, 2021, 4 pages.

* cited by examiner

CORROSION AND MAR RESISTANCE OF STEEL COMPONENTS

TECHNICAL FIELD OF THE INVENTION

The present invention relates generally to methods of achieving corrosion and mar resistance of steel components.

BACKGROUND OF THE INVENTION

It is difficult to find, in a single coating, a deep black color, good scratch resistance, good corrosion resistance, low smut levels that evenly cover low and high silicon steels, as well as smooth or rough surfaces.

SUMMARY OF THE INVENTION

The present invention relates to a method of improving corrosion and mar resistance of steel components by creating a black magnetite finish, with a medium temperature process, prior to application of a phosphate layer coating.

BRIEF DESCRIPTION OF THE DRAWINGS

For the purpose of facilitating an understanding of the subject matter sought to be protected, there are illustrated in the accompanying drawings embodiments thereof, from an inspection of which, when considered in connection with the following description, the subject matter sought to be protected, its construction and operation, and many of its advantages should be readily understood and appreciated.

DETAILED DESCRIPTION

Figure 1:
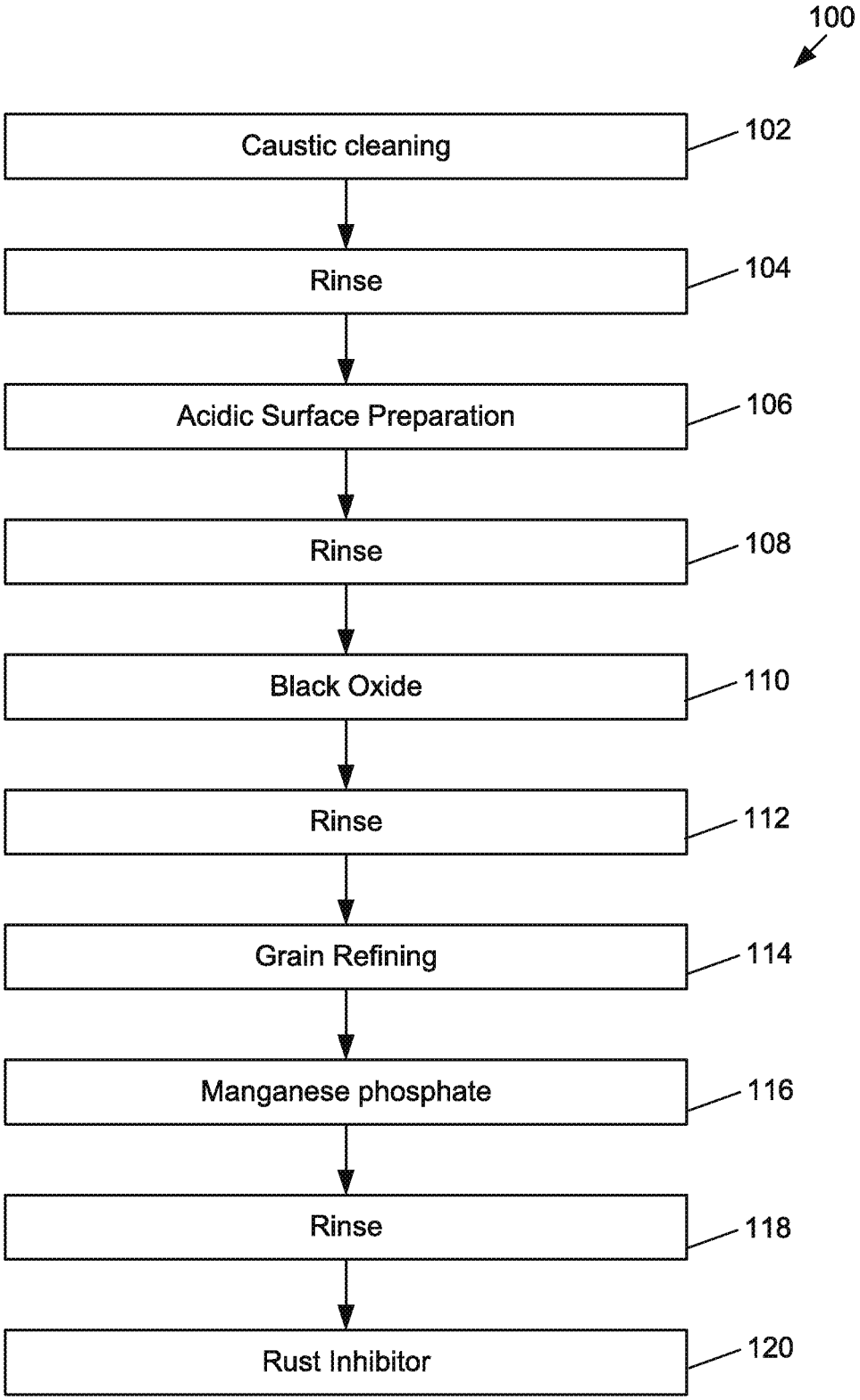
FIG. 1 is flow diagram of a method according to an embodiment of the present invention.

While this invention is susceptible of embodiments in many different forms, there is shown in the drawings, and will herein be described in detail, a preferred embodiment of the invention with the understanding that the present disclosure is to be considered as an exemplification of the principles of the invention and is not intended to limit the broad aspect of the invention to embodiments illustrated. As used herein, the term "present invention" is not intended to limit the scope of the claimed invention and is instead a term used to discuss exemplary embodiments of the invention for explanatory purposes only.

The present invention relates to a method of improving corrosion and mar resistance of steel components by creating a black magnetite finish, with a medium temperature process, prior to application of a phosphate layer coating.

FIG. 1 illustrates a flow diagram of a method 100 according to the present invention. In step 102, a steel component is subjected to caustic cleaning to remove particles and/or oil from the steel component. For example, the steel component may be immersed in a caustic cleaning solution at about 105° F. for about 5 minutes. The cleaning solution can be any caustic aqueous solution with a surfactant penetrating action and soil-dispersing ability in order to remove dirt and grease from the steel component. In step 104, the steel component is rinsed to remove any caustic film on the steel component from step 102. For example, the steel component may be immersed in water at ambient temperature for about 0.5 minutes.

In step 106, the steel component is subjected to acidic surface preparation to facilitate surface pickling/activation to facilitate chemical reaction. For example, the steel component may be immersed in an acid or acidic solution at ambient temperature for about 4.5-5 minutes. Any acidic compound can be used that provides good descaling properties on the steel to be used. In step 108, the steel component is rinsed to remove any acid on the steel component from step 106. For example, the steel component may be immersed in water at ambient temperature for about 0.5 minutes.

In step 110, the steel component is subjected to black oxide treatment to facilitate creation of a conversion layer on the surface of the steel component. The reaction allows the formation of magnetite on the surface of the steel component ($Fe_3O_4$). This layer is about 1 micrometer deep or thick, thus providing a mechanical resistance to surface abrasion during the chemical reactions that occur while moving in a barrel. For example, the steel component may be immersed in a black oxide at about 210-220° F. for about 10 minutes. The black oxide is an aqueous solution with sodium nitrate at about 7 to 13% and sodium hydroxide at about 1 to 5%. In step 112, the steel component is rinsed to remove chemical(s) remaining on the steel component from step 110. For example, the steel component may be immersed in water at ambient temperature for about 2 minutes.

In step 114, the steel component is subjected to a grain refining treatment to facilitate creation of a fine crystalline manganese phosphate coating (described in step 116 below). For example, the steel component may be immersed in a grain refining solution containing one or more activating agents at about 86° F. for about 2 minutes. The grain refining solution may be a combination of Tetrasodium pyrophosphate at a concentration of about 2.5 pounds per 100 gallons of water, and Triethanolamine at a concentration of about 0.4 to 2.5 pounds per 100 gallons of water. In step 116, the steel component is subjected to a manganese phosphate. For example, the steel component may be immersed in a phosphating solution at about 180° F. for about 15 minutes. The phosphating solution may be a combination of Manganese dihydrogenphosphate at about 3 to 4%, Phosphoric acid at about 0.7% to 1.4%, Manganese nitrate at about 0.1 to 0.7% and Nickel nitrate at about 0.1%. The acid reacts with the iron on the surface of the steel component, locally precipitating the phosphates at the surface.

In step 118, the steel component is rinsed to remove the previous chemicals/chemistry on the steel component from steps above. For example, the steel component may be immersed in water at ambient temperature for about 2 minutes. In step 120, the steel component is subjected to a rust inhibitor treatment to provide additional corrosion protection and a shiny appearance to the steel component. For example, the steel component may be immersed in one or more rust inhibitors at ambient temperature for about 1 minute. The rust inhibitor may be any oil based on hydrotreated petroleum distillates that provides corrosion protection and a deep black appearance. Different additives on the oil may provide enhanced properties, such as increased corrosion protection or a shinier appearance.

Figure 2:
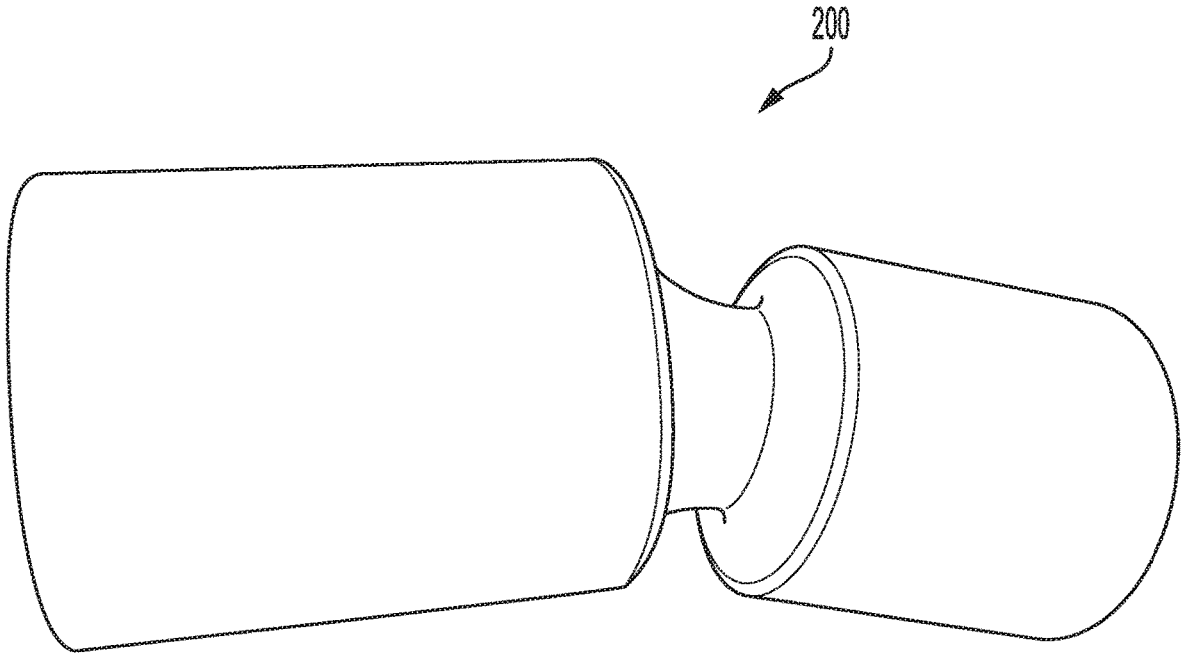
FIG. 2 is a perspective view of a component subjected to the method of FIG. 1.

FIG. 2 shows an appearance of a finished component 200 according to the method of FIG. 1. The final appearance of the finished component 200 has a deep black color given by step 110, and a phosphate coating, given by step 116, with a range in weight from 400-2000 milligrams per square foot.

The final layer meets the requirements of military Detail Specification MIL-DTL-16232G Type M and Commercial Item Description A-A-59267 Type M.

In an embodiment, the steel component(s) may be transferred though the process of FIG. 1 using a rotating barrel. For example, one or more steel components may be placed into a barrel (typically to fill the barrel about ⅓ of the way full). The barrel may then be immersed in one or more chemical and rinse tanks, wherein the barrel is rotated to achieve the improved corrosion and mar resistance of the steel components.

In another embodiment, the process of FIG. 1 can be carried out using a rack or other fixture to hold one or more steel components. The component(s) can then be transferred though the process of FIG. 1 using the rack/fixture.

The process described above with respect to FIG. 1 provides an improved conversion layer of steel that, without affecting productivity, solves problems with other processes by combining two chemical processes that transform a steel surface: oxidation of the iron creating a deep scratch resistant black appearance, and corrosion protection by growing a phosphate layer over the top of the oxidation.

Figure 3:
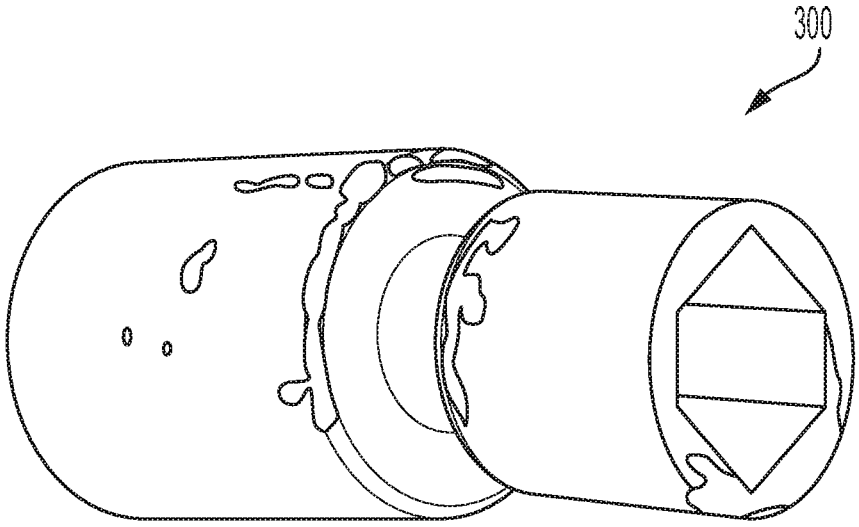
Prior Art FIG. 3
FIG. 3 is a perspective view of a component subjected to a medium temperature black oxide method.
Figure 4:
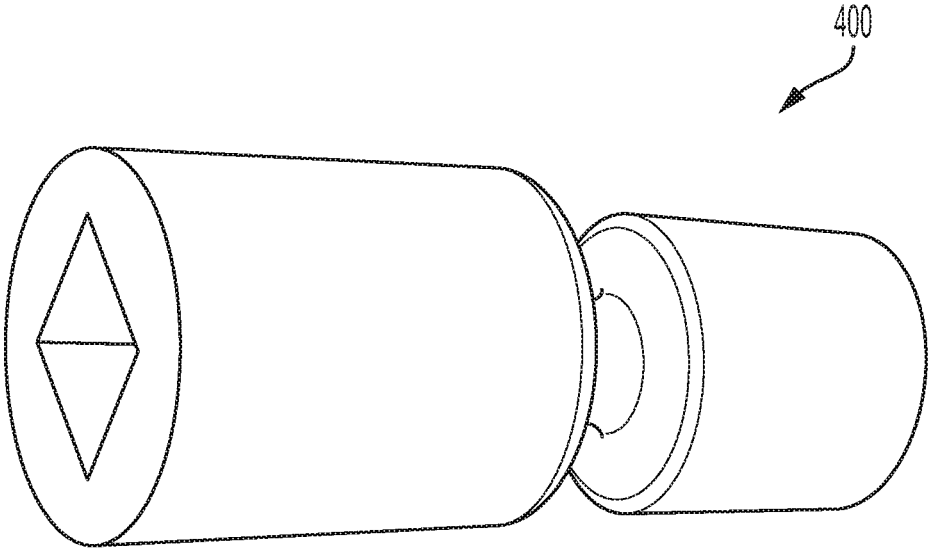
Prior Art FIG. 4
FIG. 4 is an image of a phosphate coating when done in a barrel process.

For example, the use of a medium temperature black oxide treatment requires use of expensive rust inhibitor and replacement/rework of corroded parts. Further, high smut causes blackening of packaging and skin during handling. FIG. 3 shows an appearance of a component 300 according to this method, after 24 hours of exposure to saline solution. In another example, the use of a high temperature black oxide treatment provides similar corrosion protection as that of a medium temperature black oxide treatment. However, it causes a red appearance on high silicon steels. Further, the common phosphate coating, when processed in a barrel, has a poor appearance due to scratching during the high sensitive intermediate blackening process. FIG. 4 shows an appearance of a component 400 according to this method.

As described above with reference to FIGS. 1 and 2, the present invention provides a process of creating an improved conversion layer of steel that, without affecting productivity, solves the problems associated with the medium and high temperature black oxide treatments. The present invention combines two conversions layers—a magnetite formation at medium temperature and a subsequent phosphate layer to improve the actual state, as well as the alternative processes available in the market, by eliminating the smut, improving the appearance with a deep black and high mar resistance, and exceptional corrosion resistance by improving oil retention on the surface yet still showing a dry/matte appearance.

As used herein, the term "coupled" and its functional equivalents are not intended to necessarily be limited to direct, mechanical coupling of two or more components. Instead, the term "coupled" and its functional equivalents are intended to mean any direct or indirect mechanical, electrical, or chemical connection between two or more objects, features, work pieces, and/or environmental matter. "Coupled" is also intended to mean, in some examples, one object being integral with another object. As used herein, the term "a" or "one" may include one or more items unless specifically stated otherwise.

The matter set forth in the foregoing description and accompanying drawings is offered by way of illustration only and not as a limitation. While particular embodiments have been shown and described, it will be apparent to those skilled in the art that changes and modifications may be made without departing from the broader aspects of the inventors' contribution. The actual scope of the protection sought is intended to be defined in the following claims when viewed in their proper perspective based on the prior art.

What is claimed is:

1. A method of treating a steel component, comprising:

subjecting the steel component to a black oxide treatment; and after subjecting the steel component to the black oxide treatment, subjecting the steel component to a manganese phosphate treatment that includes a phosphating solution having a temperature of about 180° F., wherein the phosphating solution includes manganese dihydrogenphosphate at about 3 to 4%, phosphoric acid at about 0.7% to 1.4%, manganese nitrate at about 0.1 to 0.7%, and nickel nitrate at about 0.1%.

2. The method of claim 1, wherein the step of subjecting the steel component to the black oxide treatment includes subjecting the steel component to the black oxide treatment having a temperature of a range of about 210-220° F.

3. The method of claim 2, wherein the black oxide treatment includes an aqueous solution including sodium nitrate at about 7 to 13% and sodium hydroxide at about 1 to 5%.

4. The method of claim 2, wherein the black oxide treatment includes an aqueous solution including sodium nitrate and sodium hydroxide.

5. The method of claim 1, further comprising subjecting the steel component to a grain refining treatment prior to subjecting the steel component to the manganese phosphate treatment.

6. The method of claim 5, wherein the grain refining treatment includes a grain refining solution having a temperature of about 86° F.

7. The method of claim 6, wherein the grain refining solution includes tetrasodium pyrophosphate at a concentration of about 2.5 pounds per 100 gallons of water and triethanolamine at a concentration within a range of about 0.4 to 2.5 pounds per 100 gallons of water.

8. The method of claim 1, further comprising the step of subjecting the steel component to a rust inhibitor treatment.

9. A method of treating a steel component, comprising:

subjecting the steel component to a black oxide treatment; and after subjecting the steel component to the black oxide treatment, subjecting the steel component to a manganese phosphate treatment that includes a phosphating solution, having manganese dihydrogenphosphate at about 3 to 4%, phosphoric acid 0.7% to 1.4%, manganese nitrate at about 0.1 to 0.7%, and nickel nitrate at about 0.1%.

* * * * *